United States Patent [19]

Hamaoka et al.

[11] 4,283,479

[45] Aug. 11, 1981

[54] SILVER HALIDE PHOTOGRAPHIC MATERIALS AND A PROCESS FORMING RELIEF IMAGES

[75] Inventors: Tsutomu Hamaoka; Yasuo Kasama, both of Minami-ashigara, Japan

[73] Assignee: Fuji Photo Film Co., Ltd., Minami-ashigara, Japan

[21] Appl. No.: 123,611

[22] Filed: Feb. 22, 1980

[30] Foreign Application Priority Data

Feb. 26, 1979 [JP] Japan ..... 54/21650

[51] Int. Cl.[3] ..... G03C 1/48; G03C 5/00

[52] U.S. Cl. ..... 430/264; 430/440; 430/480; 430/566

[58] Field of Search ..... 430/255, 264, 566, 436, 430/440, 442, 480, 483, 485

[56] References Cited

U.S. PATENT DOCUMENTS

| | | | |
|---|---|---|---|
| Re. 29,148 | 3/1977 | Yoshida et al. | 430/483 |
| 2,592,368 | 4/1952 | Yackel et al. | 430/264 |
| 2,751,295 | 6/1956 | Salminen et al. | 430/264 |
| 3,440,049 | 4/1969 | Moede | 430/483 |

*Primary Examiner*—Richard L. Schilling

*Attorney, Agent, or Firm*—Sughrue, Mion, Zinn, Macpeak and Seas

[57] ABSTRACT

Silver halide photographic materials providing wash-off relief images and having excellent shelf life comprising a support having formed thereon at least a silver halide photosensitive emulsion layer and said silver halide emulsion layer or another hydrophilic colloid layer containing a polyhydroxy-spiro-bis-chroman tanning developing agent and a gallic acid alkyl ester is disclosed with a process forming relief images.

10 Claims, No Drawings

SILVER HALIDE PHOTOGRAPHIC MATERIALS AND A PROCESS FORMING RELIEF IMAGES

BACKGROUND OF THE INVENTION

1. Field of the Invention

This invention relates to a silver halide photographic material containing a photographic tanning developing agent and, more particularly, to a silver halide photographic material containing a polyhydroxy-spiro-bis-chroman developing agent and a gallic acid alkyl ester.

2. Description of the Prior Art

In general, catechol, hydroquinone, pyrogallol, etc., have been known for a long time as so-called tanning developing agents which act as strong developing agents for photosensitive silver halides and form oxidation products which react with gelatin to tan it strongly. It has also been widely known to use these tanning developing agents in photographic emulsions or developers as disclosed in U.S. Pat. No. 2,592,368. In the case of using tanning developing agents in developers, it is sometimes more difficult to obtain images having excellent sharpness as compared to when using tanning developing agents in photographic emulsion layers because the tanning developing agents are more likely to diffuse and move through silver halide emulsion layers during development. The image density obtained when the tanning developing agents are in developers is less as compared to the latter case because the developing agents do not act sufficiently and hence tanning of image areas is incomplete. As a result the tanned image areas are partially dissolved in subsequent processing steps. Consequently, it is generally preferred, in obtaining so-called wash-off relief images, to incorporate tanning developing agents in photographic materials rather than in the developers.

When water-soluble tanning developing agents such as pyrogallol and hydroquinone are incorporated in silver halide emulsion layers or layers adjacent thereto, the developing agents tend to have an undesirable effect on photographic properties. They may cause fogging upon storage of the photographic materials for a long period of time, a reduction in image density upon development as a result of a reduction in developing activity, and insufficient tanning. Also, when photographic materials prepared by coating a support with a silver halide photographic emulsion containing a tanning developing agent are processed with an alkaline aqueous solution after light exposure, sometimes the developing agent is quickly lost in the alkaline solution and hence a suitable silver density and sufficiently tanned images are not obtained.

Furthermore, because most tanning developing agents diffuse through coated gelatin layers, they can cause tanning of non-image areas. Therefore, to obtain preferred wash-off relief images with good photographic properties, tanning developing agents which have a strong developing activity, the oxidation products of which have a good tanning property, and which are stable for a long period of time when added to silver halide emulsions are needed. Moreover, to prevent tanning non-exposed areas, the diffusion speed of the developing agents in gelatin layers or gelatino silver halide emulsion layers should not be too high.

U.S. Pat. No. 2,751,295 discloses that 6,7,6',7'-tetrahydroxy-4,4,4',4'-tetramethyl-bis-2,2'-spiro-chroman which is a compound of formula (I) of the present invention is a tanning developing agent. However, the U.S. patent says only that the compound does not exhibit the preferred properties of catechol derivatives. In more detail, the patent does not teach the use of the spiro-chroman compound with the gallic acid ester of formula (II) as in this invention nor does it suggest that the objects of this invention can be obtained by using a spiro-chroman of formula (I) and the gallic acid ester of formula (II) in combination.

U.S. Pat. No. 3,440,049 discloses that a polyhydroxy-spiro-bis-indane compound can be used together with the compound of formula (II) but the polyhydroxy-spiro-bis-indane compound is quite different from the compounds of formula (I), and it is clear that the combination described in that patent is different than the combination of the present invention. Furthermore, the use of the indane compound sometimes gives rise to insufficient image density and the compound is not easily prepared or readily available. One of the characteristic features of this invention is that it overcomes the defects of conventional tanning developing agents such as the polyhydroxyspiro-bis-indane compound and catechol.

Furthermore, U.S. Pat. No. 3,453,109 discloses that a 4-substituted-3-pyrazolidone compound and gallic acid can be used as developing agents for obtaining relief images. However, the patent neither discloses the use of gallic acid and the compounds of formula (I) in this invention nor does it teach the use of the gallic acid esters of formula (II) which are characteristic of this invention. On the other hand, the present invention does not use the compound of formula (II) and the 4-substituted-3-pyrazolidone compound without the compound of formula (I). That is, the present invention is based on the discovery that when the compound of formula (I) is used together with the compound of formula (II), excellent results which are not expected based on conventional knowledge are obtained.

SUMMARY OF THE INVENTION

One object of this invention is to provide photographic materials containing tanning developing agents which provide wash-off relief images having high photographic density and excellent image quality.

Another object of this invention is to provide photographic materials providing wash-off relief images and having excellent shelf life.

A further object of this invention is to provide photographic materials providing wash-off relief images containing tanning developing agents which can be easily prepared or are readily available.

The above-mentioned objects of this invention are attained by a silver halide photographic material comprising a support having formed thereon at least a photosensitive silver halide emulsion layer and said silver halide emulsion layer or another hydrophilic colloid layer containing a compound of the formula (I) and a compound of the formula (II):

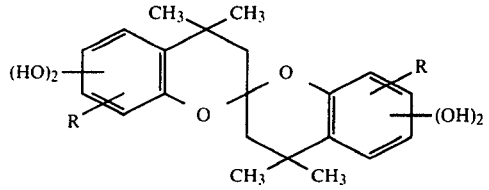

(I)

wherein R represents a hydrogen atom or an alkyl group which may be substituted;

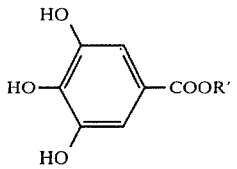

(II)

wherein R' represents an alkyl group having 1 to 10 carbon atoms.

DETAILED DESCRIPTION OF THE INVENTION

The alkyl groups represented by R in formula (I) may be straight chain or branched chain and have 1 to 10 carbon atoms. Preferred examples of the alkyl group of the compound of formula (I) are a methyl group, an ethyl group, a propyl group, a butyl group, a heptyl group, a hexyl group, a nonyl group, a decyl group, etc. The alkyl groups described above may be substituted by, for example, a halogen atom (e.g., a chlorine atom, a bromine atom, etc.), a hydroxy group, a carboxy group, an alkoxy group (e.g., an alkoxy group having 1 to 4 carbon atoms), or a primary, secondary, or tertiary amino group (e.g., ethylamine, propylamine, diethylamine). However, an unsubstituted or substituted alkyl group having 1 to 5 carbon atoms is preferred for excellent solubility and photographic properties.

Preferred examples of R' in general formula (II) are the same as those of R in general formula (I) (i.e., a straight chain or branched chain alkyl group having 1 to 10 carbon atoms) but an alkyl group having 1 to 5 carbon atoms is most preferred for excellent photographic properties and solubility and among these, a propyl group is particularly preferred. The alkyl group (e.g., propyl group) of R' may be substituted by, for example, a hydroxy group or a carboxy group.

Examples of compounds of formula (I) used in this invention are illustrated below, although the invention is not limited to these materials alone.

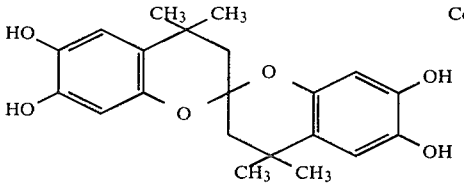

Compound (I-1)

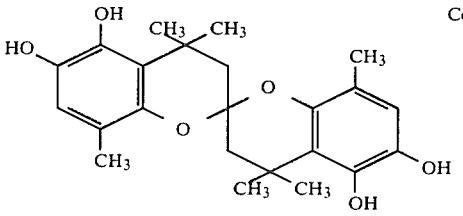

Compound (I-2)

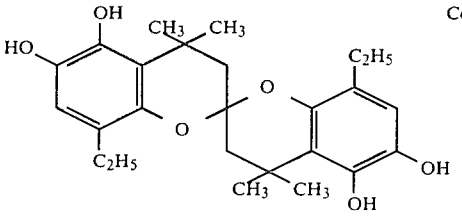

Compound (I-3)

-continued

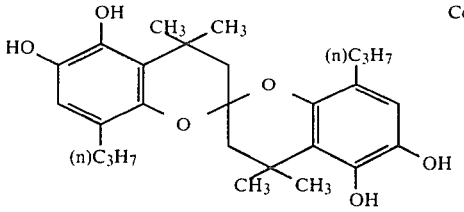

Compound (I-4)

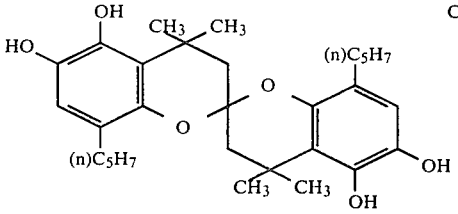

Compound (I-5)

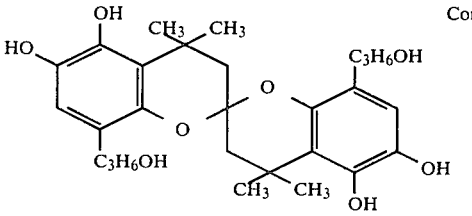

Compound (I-6)

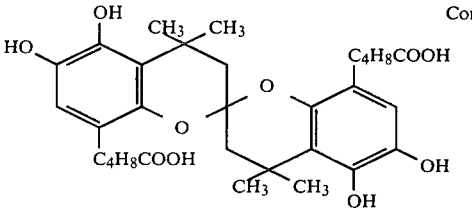

Compound (I-7)

Preferred examples of the compounds of formula (II) are illustrated below. Again these examples are not to be considered as limiting.

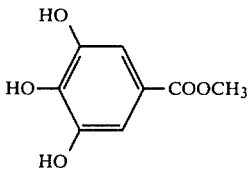

Compound (II-1)

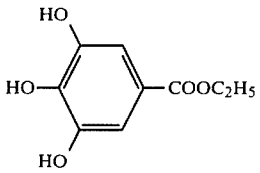

Compound (II-2)

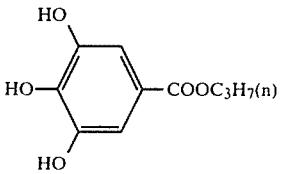

Compound (II-3)

-continued

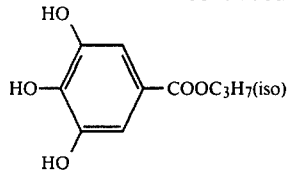

Compound (II-4)

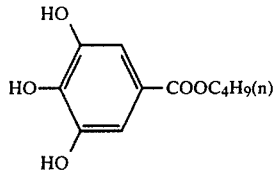

Compound (II-5)

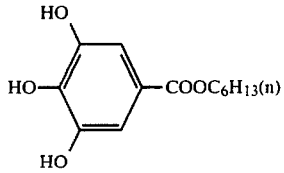

Compound (II-6)

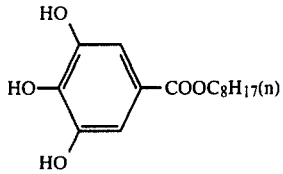

Compound (II-7)

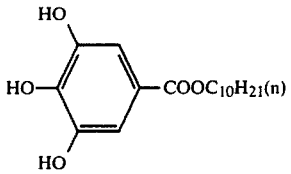

Compound (II-8)

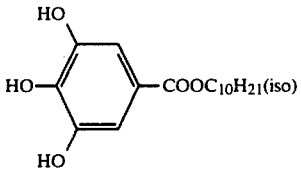

Compound (II-9)

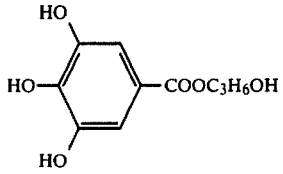

Compound (II-10)

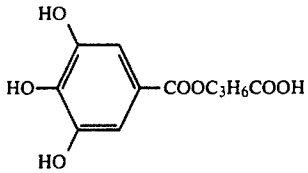

Compound (II-11)

The compounds of formula (I) can be prepared by methods similar to those used in preparing the polyhydroxy-spiro-bis-indane comounds described in U.S. Pat. No. 3,440,049 (1969) but for obtaining the polyhydroxy-spiro-bis-chromans in a high yield by not converting them into the polyhydroxy-spiro-bis-indanes. 2 mols of 1,2,4-trihydroxybenzene derivative and 3 mols of acetone are refluxed in the presence of hydrochloric acid and acetic acid to prepare the sprio-chroman compound. It is important to keep the reaction temperature as low as possible and preferably at temperatures lower than about 100° C., in particular, lower than about 80° C. These compounds can be stably incorporated in photographic materials or developers. Furthermore, the compounds show good developing activity toward exposed silver halides and also have excellent tanning action for hydrophilic protective colloids, in particular, gelatin.

Gelatin or gelatino silver halide emulsion layers tanned using the compounds of formula (I) and the compounds of formula (II) in this invention have a very high resistance to an alkaline solution. Furthermore, since the compounds of formula (I) and the compounds of formula (II) do not cause any interaction with other photographic additives co-existing with them (e.g., antifoggants, etc.), the effects of such additives as well as the developing activity are not reduced and the tanning activity of the developing agents is good.

To disperse the compounds of formula (I) and formula (II) in a silver halide emulsion layer or other hydrophilic colloid layer, alkali solutions of the compounds neutralized as described in U.S. Pat. No. 3,440,049 may be used, or the compounds may be dispersed as solutions thereof in a water-soluble organic solvent such as cyclohexanone, acetone, methoxy ethnaol, ethoxy ethanol, ethylene glycol, dioxane, dimethylformamide, etc. In another technique, the compounds can be dispersed as solutions in high boiling organic solvents such as used in dispersing couplers as described in U.S. Pat. No. 3,676,137 (e.g., butyl phthalate, dinonyl phthalate, butyl benzoate, diethylhexyl sebacate, butyl stearate, dinonyl maleate, tributyl citrate, tricresyl phosphate, dioctylbutyl phosphate, trihexyl phosphate, trioctadecyl phosphate, etc.), or dispersed as solutions in diethyl succinate, dioctyl adipate, 3-ethylbiphenyl, etc. Furthermore, when dispersing the tanning developing agents solution as described above in a hydrophilic protective colloid solution, a surface active agent such as saponin, sodium alkylsulfosuccinate, sodium alkylbenzenesulfonate, etc., may also be used.

Preferably the compound of formula (I) is incorporated in a photographic material in an amount of about 0.01 to 1 mol per mol of silver, in particular, about 0.03 to 0.3 mol per mol of silver. Also, it is preferred that the amount of the compound of formula (II) incorporated in the photographic material be about 0.005 to 1 mol per mol of silver and particularly about 0.01 to 0.3 mol per mol of silver. The compound of formula (II) may be used in a developer in a concentration of about $10^{-5}$ to $10^{-1}$ mol/liter, however, it is preferred to incorporate the compound of formula (II) in a photographic material.

In the case of incorporating the compound of formula (I) and the compound of formula (II) in photographic materials, both compounds may be incorporated in the same photosensitive silver halide emulsion layer or the same hydrophilic colloid layer or the compounds may be incorporated in different layers.

A typical example of a hydrophilic colloid used in the photographic materials of this invention is gelatin. Other examples are casein, carboxymethyl cellulose, polyvinyl alcohol, polyvinyl pyrrolidone, styrene-maleic anhydride copolymer, a condensate of styrene-maleic anhydride copolymer and polyvinyl alcohol, a polyacrylate, ethyl cellulose, etc., although the invention is not limited to these materials.

As the gelatin used for the photographic materials of this invention, so-called alkali-treated (lime-treated) gelatin obtained by immersing gelatin in an alkaline bath before extraction, acid-treated gelatin obtained by immersing gelatin in an acid bath, or enzyme-treated gelatin as described in *Bull. Soc. Sci. Photo. Japan,* No. 16, page 30 (1966) may also be used. Furthermore, partially hydrolyzed low-molecular weight gelatin obtained by heating a gelatin as described above in a water bath or by treating it with a proteolytic enzyme may be used.

The gelatin used for the photographic materials of this invention may, if desired, be partially replaced by a cellulose derivative such as colloidal albumin, casein, carboxymethyl cellulose, hydroxyethyl cellulose, etc.; a sugar derivative such as agar agar, sodium alginate, starch derivatives, etc.; or a synthetic hydrophilic colloid such as polyvinyl alcohol, poly-N-vinyl-pyrrolidone, a polyacrylic acid copolymer, polyacrylamide, and partially hydrolyzed products of these derivatives; as well as by so-called gelatin derivatives, i.e., gelatin modified by treatment with a reagent having a group capable of reacting with an amino group, an imino group, a hydroxy group, or a carboxy group in the gelatin molecule, or a graft polymer prepared by bonding a molecular chain of another polymer to gelatin.

Examples of reagents used in preparing the above-described gelatin derivatives are the isocyanates, acid chlorides, and acid anhydrides described in U.S. Pat. No. 2,614,928; the acid anhydrides described in U.S. Pat. No. 3,118,766; the bromoacetates described in Japanese Patent Publication No. 5514/64; the phenylglycidyl ethers described in Japanese Patent Publication No. 26845/67; vinylsulfone compounds described in U.S. Pat. No. 3,132,945; the N-allylvinylsulfonamides described in British Pat. No. 861,414; the maleinimide compounds described in U.S. Pat. No. 3,186,846; the acrylonitriles described in U.S. Pat. No. 2,594,293; the polyalkylene oxides described in U.S. Pat. No. 3,312,553; the epoxy compounds described in Japanese Patent Publication No. 26845/67; the esters of acids described in U.S. Pat. No. 2,763,639; and the alkanesultones described in British Pat. No. 1,033,189.

Also, various branched polymers which are used in the above-described graft polymers of gelatin are described in, for example, U.S. Pat. Nos. 2,763,625, 2,831,767 and 2,956,884, *Polymer Letters,* 5, 595 (1967), *Phot. Sci. Eng.,* 9, 148 (1965), and *J. Polymer Sci.,* A-19, 3199 (1971) but polymers or copolymers of vinyl monomers such as acrylic acid, methacrylic acid, esters of these acids, the amide or nitryl derivatives of these acids, and styrene can be widely used. In particular, however, hydrophilic vinyl polymers having compatibility with gelatin to some extent, such as polymers or copolymers of acrylic acid, acrylamide, methacrylamide, hydroxyalkyl acrylate, hydroxyalkyl methacrylate, etc., are more preferred.

The photosensitive silver halide emulsion layers or other hydrophilic colloid layers of the photographic materials of this invention may contain synthetic polymers such as, for example, latex-like water-dispersed vinylic polymers, in particular, polymers capable of increasing the dimensional stability of photographic materials solely or in admixture with other polymers, or as a combination of the above-mentioned polymer and a hydrophilic water-permeable colloid. These polymers are described in, for example, U.S. Pat. Nos. 2,376,005, 2,739,137, 2,853,457, 3,062,674, 3,411,911, 3,488,703, 3,525,620, 3,635,715, 3,607,290 and 3,645,740, and British Pat. Nos. 1,186,699 and 1,307,373. Among these polymers described in the above patents, homopolymers or copolymers of an alkyl acrylate, alkyl methacrylate, acrylic acid, methacrylic acid, sulfoalkyl acrylate, sulfoalkyl methacrylate, glycidyl acrylate, glycidyl methacrylate, hydroxyalkyl acrylate, hydroxyalkyl methacrylate, alkoxyalkyl acrylate, alkoxyalkyl methacrylate, alkoxy methacrylate, styrene, butadiene, vinyl chloride, vinylidene chloride, maleic anhydride, and itaconic anhydride are generally used. When the polymers are prepared by the emulsion polymerization of these vinylic compounds, a so-called graft type emulsion-polymerized latex prepared in the presence of a hydrophilic protective colloid polymer may be used.

The compounds of formula (I) and formula (II) of this invention may be used together with a matting agent. The matting agent used in such a case may be fine particles of a water-insoluble organic or inorganic compound having a mean particle size of about 0.2 micron to 10 microns, particularly about 0.3 micron to 5 microns. Examples of the organic compound used as the matting agent are water-dispersible vinyl polymers such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate, polytetrafluoroethylene, etc.; cellulose derivatives such as methyl cellulose, ethyl cellulose, cellulose acetate, cellulose acetate propionate, etc.; starch derivatives such as carboxy starch, carboxynitrophenyl starch, urea-formaldehyde-starch reaction products, etc.; gelatin hardened by a known hardening agent; and hardened gelatin in the form of fine hollow capsules obtained by the coacervation of gelatin. Examples of the inorganic compounds useful as the matting agent are silicon dioxide, titanium dioxide, magnesium dioxide, aluminum dioxide, barium sulfate, calcium carbonate, silver chloride or silver bromide desensitized by a known manner, and glass particles. The above-described matting agents may be used, if desired, in mixture.

For silver halide photographic emulsions of the photographic materials of this invention, known hardening agents such as, for example, aldehyde series compounds such as formaldehyde, glutaraldehyde, etc.; the compounds having a reactive halogen as described in U.S. Pat. No. 3,288,775, etc.; the compounds having a reactive ethylenically unsaturated bond described in U.S. Pat. No. 3,635,718, etc.; the aziridine compounds described in U.S. Pat. No. 3,017,280; the epoxy compounds described in U.S. Pat. No. 3,091,537, etc.; halogenocarboxyaldehydes such as mucochloric acid, etc.; dioxane compounds such as dihydroxydioxane, dichlorodioxane, etc.; divinylsulfone compounds or inorganic hardening agents such as chromium alum, zirconium sulfate, etc.; may be used at a concentration of less than about 20 wt % to dry gelatin. As the case may be, such a hardening agent may be omitted.

The silver halide emulsion used for the photographic materials of this invention is usually prepared by mixing an aqueous solution of a water-soluble silver salt (e.g., silver nitrate) and an aqueous solution of a water-soluble halide (e.g., potassium bromide) in the presence of an aqueous solution of a water-soluble polymer such as gelatin. As the silver halide, silver chloride, silver bromide as well as a mixed silver halide such as silver chlorobromide, silver iodobromide, silver chloroiodobromide, etc., can be used.

The form of the silver halide grains may be a cubic system, octahedron, or a mixed crystal system. There is no particular limitation on the grain size and mean grain size distribution of the silver halide grains and any type of silver halide grains can be used.

These silver halide grains are prepared in a conventional manner. As a matter of course, it is useful to employ a so-called single jet method, double jet method, control double jet method, etc., at the preparation of silver halide grains. Also, two or more kinds of silver halide photographic emulsions each prepared separately may be mixed for use.

Furthermore, the silver halide grains used in this invention may have a homogeneous crystal structure or a layer crystal structure having different properties between the inner and the outer side of the grain. Also, the silver halide grains may be of so-called conversion type grains as described in British Pat. No. 635,841 and U.S. Pat. No. 3,622,318. They may be of a type in which the latent images are mainly formed on the surfaces thereof, or a type in which latent images are formed inside the grains. These photographic silver halide emulsions are described, for example, in Mees, *The Theory of Photographic Process,* published by Macmillan Co., P. Grafikides, *Chimie Photographique,* published by Paul Montel (1957), etc., and may be prepared by various methods such as an ammoniacal method, a neutral method, an acid method, etc.

Silver halide grains thus formed are washed with water to remove from the system by-product water-soluble salts (e.g., potassium nitrate in case of preparing silver bromide using silver nitrate and potassium bromide) and then heat-treated in the presence of a chemical sensitizer such as sodium thiosulfate, N,N,N'-trimethylthiourea, a thiocyanate complex salt of monovalent gold, a thiosulfate complex salt, stannous chloride, hexamethylenetetramine, etc., to increase their sensitivity without increasing their grain size. These methods are also described in the above references.

The silver halide emulsions described above can be chemically sensitized in an ordinary manner. Examples of the chemical sensitizers used in such cases are the gold compounds such as chloroaurates, gold trichloride, etc., described in U.S. Pat. Nos. 2,399,083, 2,540,085, 2,597,856 and 2,597,915, the salts of noble metals such as platinum, palladium, iridium, rhodium, ruthenium, etc., described in U.S. Pat. Nos. 2,448,060, 2,540,086, 2,566,245, 2,566,263 and 2,598,079, the sulfur compounds capable of forming silver sulfide by the reaction with silver salts described in U.S. Pat. Nos. 1,574,944, 2,410,689, 3,189,458 and 3,501,313, the stannous salts, amines and other reducing materials described in U.S. Pat. Nos. ,2,487,850, 2,518,698, 2,521,925, 2,521,926, 2,694,637, 2,983,610 and 3,201,254, and other reducing materials.

The photographic silver halide emulsions used in this invention may be spectrally sensitized or supersensitized, if desired, using cyanine dyes such as cyanine, merocyanine, carbocyanine, etc., solely or as a combination thereof or as a combination of them with styryl dyes, etc. These dye sensitization techniques are well known and are described in, for example, U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, West German patent applications (OLS) No. 2,030,326 and 2,121,780, Japanese Pat. Publications Nos. 4936/68, 14030/69 10773/68, U.S. Pat. Nos. 3,511,664, 3,552,052, 3,527,641, 3,615,613, 3,615,632, 3,617,295, 3,635,721 and 3,694,217 and British Pat. Nos. 1,137,580 and 1,216,203. These techniques are selected depending on the wavelength region, sensitivity, etc., and the purposes and uses of the photographic materials.

To the photographic silver halide emulsion described above may be added various compounds for preventing the occurrence of a reduction in sensitivity and formation of fog during the production, preservation or processing of the photographic materials. As such additives, a very large number of compounds have been known such as 4-hydroxy-6-methyl-1,3,3*a*,7-tetrazaindene, 3-methylbenzothiazole, 1-phenyl-5-mercaptotetrazole, as well as many heterocyclic compounds, mercury-containing compounds, mercapto compounds, metal salts, etc.

Practical examples of these additives are described in K. Mees, *The Theory of the Photographic Process,* 3rd Edition, pages 344–349 (1966) as well as U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339 and British Pat. Nos. 893,428, 403,789, 1,173,609 and 1,200,188.

The photographic silver halide emulsions used in this invention may further contain one or more surface active agents. They are usually used as a wetting agent but, as the case may be, they are used for other purposes such as improving the emulsified dispersibility, sensitization, and photographic properties, or antistatic property and adhesion prevention. As these surface active agents, there are natural surface active agents such as saponin, etc.; nonionic surface active agents such as alkylene oxide series surfactants, glycerol series surfactants, glycidol series surfactants, etc.; cationic surface active agents such as higher alkylamines, quarternary ammonium salts, heterocyclics as pyridine, etc., phosphoniums, sulfoniums, etc.; anionic surface active agents containing acid groups such as carboxylic acid, sulfonic acid, phosphoric acid, sulfuric acid group, phosphoric acid ester group, etc.; and amphoteric surface active agents such as aminoacids, aminosulfonic acids, and sulfuric or phosphoric esters of amino alcohol.

Examples of the surface active agents useful in this invention are described in, for example, U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, West German patent application (OLS) No. 1,942,665 and British Pat. Nos. 1,077,317 and 1,198,450 as well as Ryohei Oda et al., *Synthesis of Surface Active Agents and Application Thereof,* published by Maki Shoten, 1964, A. W. Berry, *Surface Active Agents,* published by Interscience Publication Inc. 1958, and J. P. Sisley, *Encyclopedia of Surface Active Agents,* Vol. 2, published by Chemical Publish Company, 1964.

The photographic silver halide emulsions described above are coated on flat materials which are not subject to dimensional deformation during processing, for example, hard supports such as glass sheets, metal sheets, porcelains, etc., or flexible supports according to the purpose of the photographic materials.

Typical examples of the flexible supports are those ordinarily employed for photographic materials, such as cellulose nitrate films, cellulose acetate films, cellulose acetate butyrate films, cellulose acetate propionate films, polystyrene films, polyethylene terephthalate films, polycarbonate films, laminates of these films, thin glass sheets, baryta-coated papers, papers laminated with a polymer of an α-olefin having 2 to 10 carbon atoms such as an α-polyolefin polymer, in particular, polyethylene, polypropylene or an ethylene-butene copolymer, and plastic films having improved adhesion to other polymers and improved printability by roughening the surfaces thereof as described in Japanese Pat. Publication No. 19068/72.

The supports used may be transparent or opaque according to the purpose of the photographic materials. Also, in the case of using transparent supports, they may be colorless or may be colored, as the case may be, by addition thereto of dyes or pigments. This coloring technique is known in X-ray films, etc., and described in, for example, *J. of S.M.P.T.E.*, 67, 296 (1958).

Opaque supports used in this invention include originally opaque supports such as papers, opaque films prepared by incorporating a pigment such as titanium oxide, etc., in transparent films, plastic films the surfaces of which have been treated by the method described in Japanese Pat. Publication No. 19068/72, and papers, plastic films, etc., which have been rendered completely light shielding by addition thereto carbon black and dye, etc. When the adhesion between a support and photographic silver halide emulsion layer is insufficient, it has been attempted to form a subbing layer on the support. Also, for further improving the adhesion, a pre-surface treatment such as corona discharge treatment, ultraviolet irradiation, flame treatment, etc., may be applied to the surface of the support.

Each photographic layer of the photographic materials of this invention may be coated by various coating methods, such as dip coating method, air knife coating method, curtain coating method, spray coating method, and extrusion coating method using the hopper described in U.S. Pat. No. 2,681,294. Furthermore, if necessary, two or more photographic layers can be coated simultaneously by the method described in U.S. Pat. Nos. 2,761,791, 3,508,947, 2,941,898 and 3,526,528.

The development used in this invention differs from a conventional black-and-white development only in that an alkali activator is used as the developing bath. The other steps are the same in the processes. The pH of the activator is about 8 to 14, particularly about 9 to 13. The temperature of the activator solution is usually 10 to 70° C., preferably 20° to 50° C.

The activator used in this invention is fundamentally a black-and-white developer from which the developing agent has been removed. The activator contains a buffer such as sodium hydroxide, potassum hydroxide, sodium carbonate, potassium carbonate, sodium tertiary phosphate, potassium tertiary phosphate, potassium metaborate, borax, etc., and they may be used alone or as a mixture. Also, for further obtaining buffer function, for the convenience of the preparation of the activators or for increasing the ion strength, disodium hydrogenphosphate, dipotassium hydrogenphosphate, sodium dihydrogenphosphate, potassium dihydrogenphosphate, sodium hydrogencarbonate, potassium hydrogencarbonate, boric acid, an alkali nitrate, an alkali sulfate, etc., may be used.

Also, the activator may further contain about $10^{-5}$ to $10^{-1}$ mol/l of a suitable develoment inhibitor such as an inorganic halide and about $10^{-6}$ to $10^{-1}$ mol/l of a known organic antifoggant. Typical examples of the inorganic halide are bromides such as sodium bromide, potassium bromide, ammonium bromide, etc., and iodides such as potassium iodide and sodium iodide. On the other hand, examples of the organic antifoggant are 6-nitrobenzindazole described in U.S. Pat. No. 2,496,940; 5-nitrobenzimidazole described in U.S. Pat. Nos. 2,497,917 and 2,656,271; diaminophenazine, o-phenylenediamine, mercaptobenzimidazole, methylbenzothiazole, mercaptobenzoxazole, thiouracil, and 5-methylbenzotriazole described in *J. the Soc. of Photo. Sci. and Tech. of Japan*, Vol. 11, page 48 (1948); and the heterocyclic compounds described in Japanese Pat. Publication No. 41675/71. Moreover, the antifoggants described in *Kagaku Shashin Binran* (Handbook of Scientific Photography), Vol. 2, page 119 (1959, published by Maruzen K.K.) can be also used in this invention.

To control development of the surface layer, the development inhibitors disclosed in Japanese Pat. Publications Nos. 19039/71 and 6149/70 and U.S. Pat. No. 3,295,976 may be used.

Other additives such as ammonium chloride, potassium chloride, sodium chloride, etc., may be added, if desired or necessary, to the activators used in this invention. Also, if desired or necessary, development accelerators can be added to the activator solution. Examples of these development accelerators are various pyridinium compounds and other cationic compounds described in U.S. Pat. No. 2,648,604, Japanese Pat. Publication No. 9503/69 and U.S. Pat. No. 3,671,247; cationic dyes such as phenosaframin; neutral salts such as thallium nitrate and potassium nitrate; the nonionic compounds such as polyethylene glycol, the derivatives thereof and polythioethers described in Japanese Pat. Publication No. 9504/69, and U.S. Pat. Nos. 2,533,990, 2,531,832, 2,950,970 and 2,577,127; organic solvent and the organic amines, ethanolamine, ethylenediamine, and diethanolamine described in Japanese Pat. Publication 9509/69 and Belgian Pat. No. 682,862. Other examples of the accelerators are described in L.F.A. Mason, *Photographic Processing Chemistry*, pages 40–43 (Focal Press-London 1966).

Sodium sulfite, potassium sulfite, potassium hydrogensulfite, sodium hydrogensulfite, etc., may also be added to the activators used in this invention.

Furthermore, polyphosphate compounds exemplified by sodium hexametaphosphate, sodium tetrapolyphosphate, sodium tripolyphosphate, potassium hexametaphosphate, potassium tetrapolyphosphate, potassium tripolyphosphate, etc., and aminopolycarboxylic acids exemplified by ethylenediaminetetraacetic acid, nitrilotriacetic acid, cyclohexanediaminetetraacetic acid, iminodiacetic acid, N-(hydroxymethyl)ethylenediaminetriacetic acid, diethylenetriaminepentaacetic acid, etc., may be used as a water softener. The amount thereof depends upon the hardness of water used but usually is about 0.5 to 10 g/liter. In addition, a calcium or magnesium type masking agent can also be used. They are described in detail in J. Willems, *Belgisches Chemiches Industry*, 21, 325 (1956) and *ibid.*, 23, 1105 (1958).

The invention will further be described by the following example.

EXAMPLE

A wash-off type silver halide photographic film was prepared in the following manner.

Sample A:

A silver halide emulsion containing 175 g of gelatin and 1.5 mols of silver chlorobromide (30 mol % silver bromide) in 2,000 g of water was prepared. The mean grain size of the silver chlorobromide grains was 0.4 micron. After removing the soluble salt by-product in a conventional manner, the silver halide emulsion was chemically sensitized by the addition of sodium thiosulfate. The following materials were added to the silver halide emulsion.

| | |
|---|---|
| Saponin (6% aq. soln.) | 20 g |
| Benzotriazole (1% methanol soln.) | 4 g |
| Tartrazine (10% aq. soln.) | 250 g |
| Solution (a) having the following composition: | 296.5 g |
| Solution (a): | |
| Compound (I-1) | 23 g |
| Compound (II-3) | 14 g |
| Dimethylformamide | 80 g |
| Ethanol | 50 g |
| Water | 120 g |

Thereafter, the silver halide emulsion was coated on a triacetate film base at a silver coverage of 3 g/m$^2$. The photographic film thus prepared is designated Sample A.

Sample B:

A silver halide emulsion containing 175 g of gelatin and 1.5 mols of silver chloride in 2,000 g of water was prepared. The mean grain size of the silver chloride grains was 0.4 micron. After removing the soluble salt in an ordinary manner, the silver halide emulsion was chemically sensitized by the addition of sodium thiosulfate. The following materials were added to the silver halide emulsion.

| | |
|---|---|
| Saponin (6% aq. soln.) | 75 g |
| Gelatin (10% aq. soln.) | 420 g |
| 2-Mercaptobenzothiazole (1% methanol soln.) | 4 g |
| Tartrazine (10% aq. soln.) | 150 g |
| Dispersion (b) prepared by the following method | 1,205 g |

Part (b-1) having the following composition and Part (b-2) having the following composition were mixed with stirring vigorously to produce a dispersion (b).

| | |
|---|---|
| Part (b-1): | |
| Compound (I-1) | 46.5 g |
| Compound (II-1) | 28.5 g |
| Tricresyl phosphate | 46 g |
| Ethyl acetate | 185 g |
| Part (b-2): | |
| Gelatin | 81 g |
| Water | 810 g |
| Saponin (6% aq. soln.) | 50 g |
| Methanol | 10 g |

Then, the silver halide emulsion was coated on a triacetate film base at a silver coverage of 3 g/m$^2$. The photographic film thus prepared is designated as Sample B.

Comparison Sample C:

A photographic film was prepared in the same manner as in the case of preparing Sample A except that 325 g of Solution (c) containing Compound (I-1) only as shown below was added in place of Solution (a) containing Compound (I-1) and Compound (II-1). The photographic film thus prepared is designated as Comparison Sample C.

| Solution (c): | |
|---|---|
| Compound (I-1) | 23 g |
| Dimethylformamide | 80 g |
| Ethanol | 50 g |
| Water | 120 g |

Comparison Sample D:

A photographic film was prepared in the same manner as Sample A except that Solution (d) containing Compound (I-1) and gallic acid was added in place of Solution (a). The photographic film thus prepared is designated as Comparison Sample D.

Solution (d):

Part (d-1) having the following composition was mixed with Part (d-2) having the following composition and the pH of the mixture was adjusted to 6.5 by adding dropwise sulfuric acid (0.3 mol/liter) slowly to the mixture to provide the solution.

| | |
|---|---|
| Part (d-1): | |
| Gelatin | 30 g |
| Water | 1,540 g |
| Sodium sulfite (10% aq. soln.) | 14 g |
| Sodium hydroxide (3 mol/l aq. soln.) | 21 g |
| Part (d-2): | |
| Compound (I-1) | 23 g |
| Gallic acid | 14 g |
| Methyl cellosolve | 36 g |

Comparison Sample E:

A photographic film was prepared by the same manner as in the case of preparing Sample A except that Solution (e) was added in place of Solution (a). Solution (e) has the same composition as Solution (a) except that 21 g of catechol was added in place of Compound (I-1) of Solution (a). The photographic film thus prepared is designated as Comparison Sample E.

Comparison Sample F:

A photographic film was prepared in the same manner as Sample A except that Solution (f) was added in place of Solution (a). Solution (f) has the same composition as Solution (a) except 35 g of 3,3,3',3'-tetramethyl-5,6,5',6'-tetrahydroxy-spiro-bis-indane was added in place of Compound (I-1) and Compound (II-3) of Solution (a). The photographic film thus prepared is designated Comparison Sample F.

Experimental Result 1:

Each of Samples A to F described above was exposed for 5 seconds under an optical wedge, developed for 10 seconds at 20° C., using an activator solution having the following composition and, thereafter, untanned portions were wiped off in warm water of 40° C. using a sponge, followed by drying.

| Activator Processing Solution: | |
|---|---|
| Potassium carbonate | 25 g |
| Potassium hydroxide | 7 g |
| Potassium sulfite | 1 g |
| Potassium bromide | 0.1 g |

-continued

| Activator Processing Solution: | |
|---|---|
| Water to make | 1 l |

The photographic properties obtained are shown in Table 1.

TABLE 1

| | Relative Sensitivity | Gamma (γ) | Maximum Density |
|---|---|---|---|
| Sample A | 100 | 3.5 | 2.66 |
| Sample B | 100 | 3.3 | 2.50 |
| Comparison Sample C | 80 | 2.5 | 2.00 |
| Comparison Sample D | 90 | 2.5 | 2.00 |
| Comparison Sample E | 50 | 1.5 | 1.86 |
| Comparison Sample F | 95 | 3.0 | 2.30 |

From the above results, it is understood that in the samples of this invention containing the compounds of formula (I) and the compounds of formula (II), a higher sensitivity, higher gamma and higher maximum density can be obtained than the sample containing the compound of formula (I) alone, the sample containing the compound of formula (I) and gallic acid, the sample containing catechol and the compound of formula (II), and the sample containing 3,3,3',3'-tetramethyl-5,6,5',6'-tetrahydroxy-spiro-bis-indane.

Experimental Result 2:

A storage test was performed on Samples A to F.

To forcibly age, the samples were allowed to stand for 3 days at a temperature of 50° C. and a relative humidity of 70%. Thereafter, the melting point of each silver halide emulsion layer and the degree of stain formation after development were determined. The results are shown in Table 2.

TABLE 2

| | Melting Point (°C.) | | Stain | |
|---|---|---|---|---|
| | No Aging | After Aging | No Aging | After Aging |
| Sample A | 38 | 40 | No stain | No stain |
| Sample B | 37 | 39 | No stain | No stain |
| Comparison Sample C | 38 | 45 | No stain | Formed a little |
| Comparison Sample D | 38 | 42 | No stain | Formed a little |
| Comparison Sample E | 36 | 45 | Formed a little | Formed |
| Comparison Sample F | 38 | 42 | No stain | Formed a little |

As is clear from the results shown in Table 2, the samples of this invention showed less of an increase in the melting point by forcible aging as well as no formation of stain, i.e., they showed excellent storage properties.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon a photosensitive silver halide photographic emulsion layer, said photosensitive silver halide emulsion layer or another hydrophilic colloid layer on said support containing a compound of the formula (I) and a compound of the formula (II):

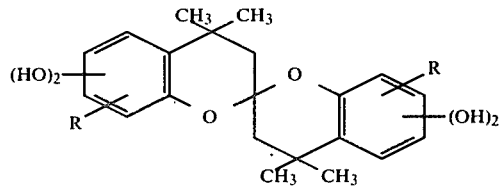

(I)

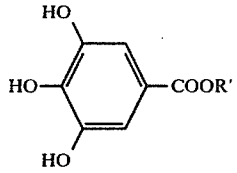

(II)

wherein R represents a hydrogen atom or an alkyl group having 1 to 10 carbon atoms and R' represents an alkyl group having 1 to 10 carbon atoms.

2. The photographic material of claim 1, wherein the amount of the compound of formula (I) is about 0.01 to 1 mol/mol Ag and the amount of the compound of formula (II) is about 0.005 to 1 mol/mol Ag.

3. The photographic material of claim 1, wherein R in the formula (I) is an alkyl group having 1 to 5 carbon atoms.

4. The photographic material of claim 1, wherein R' in formula (II) is an alkyl group having 1 to 5 carbon atoms.

5. The photographic material of claim 1, wherein R' in formula (II) is a propyl group.

6. A process for forming relief images which comprises image-wise exposing the silver halide photographic material as claimed in claim 1 followed by processing the silver halide photographic material with an alkaline aqueous solution having a pH higher than 9.

7. A process for forming relief images which comprises imagewise exposing a silver halide photographic material comprising a support having thereon at least a photosensitive silver halide photographic emulsion layer and at least one of said photosensitive silver halide emulsion layer or another hydrophilic colloid layer on said support containing a compound of the formula (I):

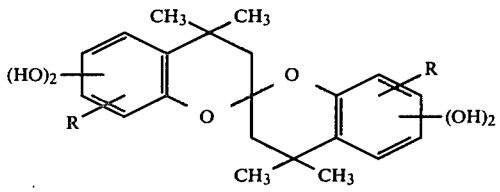

(I)

wherein R represents a hydrogen atom or an alkyl group having 1 to 10 carbon atoms, and a compound of the formula (II):

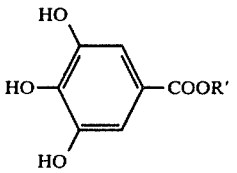

(II)

wherein R' represents an alkyl group having 1 to 10 carbon atoms, and developing said imagewise exposed material with an alkaline aqueous solution.

8. The process of claim 7, wherein R is an alkyl group having 1 to 5 carbon atoms.

9. The process of claim 7, wherein R' is an alkyl group having 1 to 5 carbon atoms.

10. The process of claim 9, wherein R' is a propyl group.

* * * * *